US009193942B2

(12) United States Patent
Manning et al.

(10) Patent No.: US 9,193,942 B2
(45) Date of Patent: Nov. 24, 2015

(54) SOAP RECYCLING AND CONVERSION PROCESS

(71) Applicants: Danielle D Manning, Baltimore, MD (US); Laverne C Dickens, Mitchellville, MD (US)

(72) Inventors: Danielle D Manning, Baltimore, MD (US); Laverne C Dickens, Mitchellville, MD (US)

( * ) Notice: Subject to any disclaimer, the term of this patent is extended or adjusted under 35 U.S.C. 154(b) by 0 days.

(21) Appl. No.: 14/093,401

(22) Filed: Nov. 29, 2013

(65) Prior Publication Data

US 2015/0152367 A1 Jun. 4, 2015

Related U.S. Application Data

(60) Provisional application No. 61/731,570, filed on Nov. 30, 2012.

(51) Int. Cl.
*C11D 13/30* (2006.01)
*C11D 3/48* (2006.01)

(52) U.S. Cl.
CPC . *C11D 13/30* (2013.01); *C11D 3/48* (2013.01)

(58) Field of Classification Search
None
See application file for complete search history.

(56) References Cited

U.S. PATENT DOCUMENTS

| | | | |
|---|---|---|---|
| 4,296,064 | A | 10/1981 | Satcher |
| 5,876,769 | A | 3/1999 | Dowden et al. |
| 6,555,508 | B1 | 4/2003 | Paul |
| 8,110,533 | B1 | 2/2012 | Tsaur |
| 8,124,574 | B2 | 2/2012 | Tsaur |
| 8,153,578 | B2 | 4/2012 | Seipler et al. |

*Primary Examiner* — Necholus Ogden, Jr.

(57) ABSTRACT

In one embodiment, a soap recycling and conversion process that processes and converts bar soap remnants or pieces into liquid soap, in anti-bacterial, organic or non-organic forms. Soap remnants are treated with an anti-bacterial cleansing solution, including ethyl alcohol; then either grated or broken into smaller pieces. The remnants or grated remains are then dissolved in warm water, either tap or purified, and combined with the conversion solution, which consists of water, glycerin, citric acid and sodium laureth sulfate (not used in organic solution). The liquefied mass is either heated in a microwave for 30-120 seconds, depending on microwave wattage; or heated in a crock pot until consistent; or whisked at room temperature until the proper consistency of liquid soap. The solution is then packaged for reuse.

5 Claims, No Drawings

SOAP RECYCLING AND CONVERSION PROCESS

CROSS-REFERENCE TO RELATED APPLICATIONS

This application claims the benefit of U.S. Provisional Patent Application No. 61/731,570, filed Nov. 30, 2012, the disclosure of which is incorporated herein by reference.

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISC APPENDIX

Not Applicable

BACKGROUND OF THE INVENTION

The present invention is in the Class 510: Cleaning Compositions for Solid Surfaces, Auxiliary Compositions Therefor, or Processes of Preparing the Compositions.

PRIOR ART RESEARCHED

U.S. Pat. No. 8,153,578; Issue Date: Apr. 10, 2012; First Named Inventor: Seipler; Title: Soap Recycling System and Method The present invention does not require the processing of the soap using a Rational Clima Plus Combi unit, nor does it require steaming the soap bar in said unit or cooling the soap bar in a refrigerator for reuse. The present invention creates liquid soap, not bar soap.

U.S. Pat. No. 5,876,769; Issue Date: Mar. 2, 1999; First Named Inventor: Dowden; Title: Heated Soap Mold Device for Recycling Soap Bar Remnants The present invention does not require the mechanized process of forming dies or the application of molding force for the recycling of soap. The present invention creates liquid soap, not bar soap.

U.S. Pat. No. 4,296,064; Issue Date: Oct. 20, 1981; First Named Inventor: Satcher; Title: Method and Structure for Recycling Soap Chips The present invention does not require utilizing a container to heat, cool and recycle the soap. The present invention creates liquid soap, not bar soap.

U.S. Pat. No. 6,555,508; Issue Date: Apr. 29, 2003; First Named Inventor: Paul; Title: Liquid Foaming Soap Compositions The present invention does not include contents that support medical applications.

U.S. Pat. No. 8,124,574; Issue Date: Feb. 28, 2012; First Inventor: Tsaur; Title: Mild, Foaming Liquid Cleansers Comprising Low Levels of Fatty Isethionate Product and Low Total Fatty Acid and/or Fatty Acid Soap Content The present invention is not a process for creating liquid foaming soap as an original composition. The present invention creates liquid soap from recycled soap pieces.

U.S. Pat. No. 8,110,533; Issue Date: Feb. 7, 2012; First Inventor: Tsaur; Title: Liquid Soap Compositions The present invention is not a process for creating liquid soap as an original composition. The present invention creates liquid soap from recycled soap pieces.

FIELD OF INVENTION

The present invention is in the technical field of cleaning compositions. More particularly, this invention is in the technical field of soap. More particularly, the present invention is in the technical field of recycling soap. More particularly, the present invention is in the technical field of processing and converting existing soap remnants into liquid soap, in anti-bacterial, organic or non-organic forms.

DESCRIPTION OF RELATED ART

Not Applicable

SUMMARY OF THE INVENTION

The present invention is a soap recycling and conversion process that processes and converts bar soap remnants, chips, scraps or pieces into liquid soap, in anti-bacterial, organic or non-organic forms.

DESCRIPTION OF DRAWINGS

Not Applicable

DETAILED DESCRIPTION OF THE INVENTION

In one embodiment, a process for recycling soap includes utilizing bar soap remnants that are treated with an anti-bacterial cleansing solution, including ethyl alcohol; then either grating the remnants or breaking them into smaller pieces.

The remnants or grated remains are then dissolved in warm water, either tap or purified, and combined with the conversion solution, which consists of water, glycerin, citric acid and sodium laureth sulfate (not used in organic solution).

The liquefied mass is either heated in a microwave for 30-120 seconds, depending on microwave wattage; or heated in a crock pot until consistent; or whisked at room temperature until the proper consistency.

The former soap bar remnants have now been converted into a liquid soap form.

While the foregoing written description of the invention enables one of ordinary skill to make and use what is considered presently to be the best mode thereof those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention.

We claim:

1. A method for recycling bar soap, which converts it into liquid soap, comprising: cleaning bar soap remnants with an anti-septic cleansing solution; grating with a grated instrument or breaking the soap remnants by hand; dissolving the remnants in warm water, 105-115 degrees F. or 40-45 degrees C.; adding a conversion solution to the remnants and warm water, which creates a liquefied soap mass; heating the liquefied mass in a microwave for 30-120 seconds, or whisking the liquefied soap mass at room temperature; and repackaging the liquefied soap mass for reuse.

2. The method of claim 1 wherein the anti-septic solution includes ethyl alcohol.

3. The method of claim 1 wherein the conversion solution includes water, glycerin, citric acid and sodium laureth sulfate.

4. The method of claim 1 wherein heating is for a period of 30-120 seconds in the microwave until the soap remnants and conversion solution reach a liquefied soap mass.

5. The method of claim 1 wherein the liquefied soap mass is whisked at room temperature for at least three (3) minutes.

* * * * *